US007568318B1

(12) United States Patent
Egan

(10) Patent No.: US 7,568,318 B1
(45) Date of Patent: Aug. 4, 2009

(54) PRE-FABRICATED WALL PANELING

(75) Inventor: Patrick Egan, Indianapolis, IN (US)

(73) Assignee: Thermocore Structural Insulated Panel Systems, Mooresville, IN (US)

( * ) Notice: Subject to any disclaimer, the term of this patent is extended or adjusted under 35 U.S.C. 154(b) by 1383 days.

(21) Appl. No.: 09/633,937

(22) Filed: Aug. 8, 2000

(51) Int. Cl.
*E04C 1/00* (2006.01)

(52) U.S. Cl. ..... 52/309.9; 52/281; 52/210; 52/309.7; 52/309.8

(58) Field of Classification Search ..... 52/220.8, 52/220.7, 220.2, 797.1, 309.2, 256, 281, 52/309.4, 309.7, 309.8, 309.9, 309.11, 210
See application file for complete search history.

(56) References Cited

U.S. PATENT DOCUMENTS

| | | | | | |
|---|---|---|---|---|---|
| 1,967,611 | A | | 7/1934 | Finck | |
| 2,200,650 | A | | 5/1940 | Welch | |
| 2,757,116 | A | | 7/1956 | Clements | |
| 3,377,756 | A | * | 4/1968 | Polhamus | 52/220.7 |
| 3,487,598 | A | * | 1/1970 | Lopina | 52/126.4 |
| 3,831,335 | A | * | 8/1974 | Ary | 52/601 |
| 4,038,796 | A | * | 8/1977 | Eckel | 52/220.7 |
| 4,109,436 | A | | 8/1978 | Berloty | 52/309.2 |
| 4,135,775 | A | * | 1/1979 | Driscoll | 439/215 |
| 4,288,962 | A | | 9/1981 | Kavanaugh | |
| 4,409,768 | A | | 10/1983 | Boden | |
| 4,486,994 | A | | 12/1984 | Fisher et al. | |
| 4,628,650 | A | | 12/1986 | Parker | 52/265 |
| 5,090,174 | A | * | 2/1992 | Fragale | 52/309.9 |
| 5,090,175 | A | * | 2/1992 | Arfert et al. | 52/309.11 |
| 5,353,560 | A | | 10/1994 | Heydon | 52/281 |
| 5,383,317 | A | * | 1/1995 | Menchetti | 52/220.2 |
| 5,497,589 | A | * | 3/1996 | Porter | 52/309.7 |
| 5,519,971 | A | * | 5/1996 | Ramirez | 52/220.2 |
| 5,653,075 | A | * | 8/1997 | Williamson | 52/309.9 |
| 5,678,381 | A | * | 10/1997 | DenAdel | 52/730.1 |
| 5,722,208 | A | * | 3/1998 | Humphrey et al. | 52/220.8 |
| 5,743,056 | A | * | 4/1998 | Balla-Goddard et al. | 52/309.11 |
| 5,765,330 | A | | 6/1998 | Richard | 52/309.13 |
| 5,771,645 | A | * | 6/1998 | Porter | 52/220.2 |

(Continued)

FOREIGN PATENT DOCUMENTS

| | | |
|---|---|---|
| JP | 3-87442 | 4/1991 |

(Continued)

OTHER PUBLICATIONS http://www.portersips.com/ordering.html, Porter Structural Insulated Panels, Mar. 6, 2002.

(Continued)

*Primary Examiner*—Richard E Chilcot, Jr.
*Assistant Examiner*—Chi Q Nguyen
(74) *Attorney, Agent, or Firm*—John H. Allie, Esq.

(57) ABSTRACT

A prefabricated wall panel is disclosed. The panel has a first exterior facing sheet of plywood or OSB and the second interior facing sheet of plywood or OSB. Framing struts are located between the sheets to secured thereto to define a panel volume. A polymeric in-situ foam core is formed inside such panel volume. The overall panel thickness is 4 inches, plus or minus 1 quarter inch. In the finished wall assembly, thickness in combination with a sheet of drywall allows flush mounting of door jambs and window jambs, including flush mounting of trim pieces. The panel has an R value in excess of R20.

33 Claims, 4 Drawing Sheets

U.S. PATENT DOCUMENTS

| | | | | | |
|---|---|---|---|---|---|
| 5,836,628 | A | * | 11/1998 | Beier | 292/346 |
| 6,041,562 | A | * | 3/2000 | Martella et al. | 52/236.7 |
| 6,180,878 | B1 | * | 1/2001 | Gretz | 174/48 |
| 6,218,612 | B1 | * | 4/2001 | McKitrick et al. | 174/48 |
| 6,256,959 | B1 | * | 7/2001 | Palmersten | 52/588.1 |
| 6,276,104 | B1 | * | 8/2001 | Long et al. | 52/309.4 |
| 2002/0194805 | A1 | | 12/2002 | Arseneau et al. | |

FOREIGN PATENT DOCUMENTS

| | | | |
|---|---|---|---|
| JP | 6-288024 | * | 4/1993 |
| JP | 5-263483 | * | 10/1993 |
| JP | 6-57857 | * | 3/1994 |
| JP | 6-136864 | * | 5/1994 |
| JP | 6-883886 | * | 6/1994 |
| JP | 6-322853 | | 11/1994 |

OTHER PUBLICATIONS http://www.winterpanel.com/manuals/pdnos13.html.

* cited by examiner

PRE-FABRICATED WALL PANELING

BACKGROUND OF THE INVENTION

This invention relates generally to prefabricated wall paneling and building assemblies made therefrom, and more specifically to such paneling having polymeric in-situ foam core, located therein.

In addition to conventional stick framing, a variety of prefabricated wall panel structures exist in the prior art to take advantage of the benefits of pre-fabricated wall paneling such as factory controlled assembly, quality and labor savings in the field when assembling a building such as a home or other structure. Examples of such prior devices are set forth in U.S. Pat. Nos. 4,109,436 by Berloty; 4,628,650 by Parker; 5,353,560 by Heydon; and 5,765,330 by Richard.

The prior art also includes pre-fabricated wall panels sold by the applicant which are substantially the same as the invention disclosed and claimed herein except that the struts are made of standard 2 inch by 4 inch nominal lumber (i.e., 1½ inch by 3½ inch actual cross-sectional dimension). As such, the overall panel thickness was approximately 4½ inches. The present invention takes advantage of these prior art advantages except that the overall panel thickness is only 4 inches total, including the struts and the two 2 generally rigid sheets on either side of the struts. The present invention provides excellent strength and thermal insulation characteristics while being a thinner and specialized thickness compared to its predecessor product. This facilitates faster and more cost effective installation because standardized window and door jambs may be mounted in predetermined locations, pre-fabricated into the panel and/or building assembly while being flush with the panel when a sheet of drywall is secured thereto. Other cost and transportation efficiencies result as well.

SUMMARY OF THE INVENTION

The invention is set forth literally in the claims. It is not to be embellished or narrowed by expressed or inferred advantages, functionalities for features in the specification. Mindful of this, the invention generally can be summarized as a prefabricated wall panel. The wall panel comprises a first, exterior facing sheet and a second interior-facing sheet spaced apart a strut thickness. At least two (2), and often times more, framing struts are located between the sheets and define a panel volume between the sheets. A polymeric in-situ foam core is located in and substantially fills the panel volume. The overall panel thickness is four (4) inches.

DESCRIPTION OF THE PREFERRED EMBODIMENTS

Figure 1A:
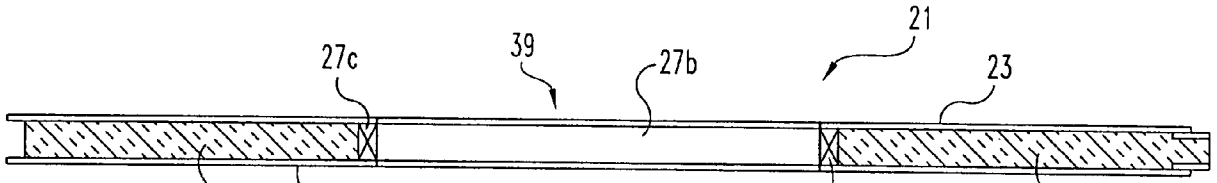
FIG. 1A is a cross-sectional view along lines 1A-1A of FIG. 1.
Figure 1B:
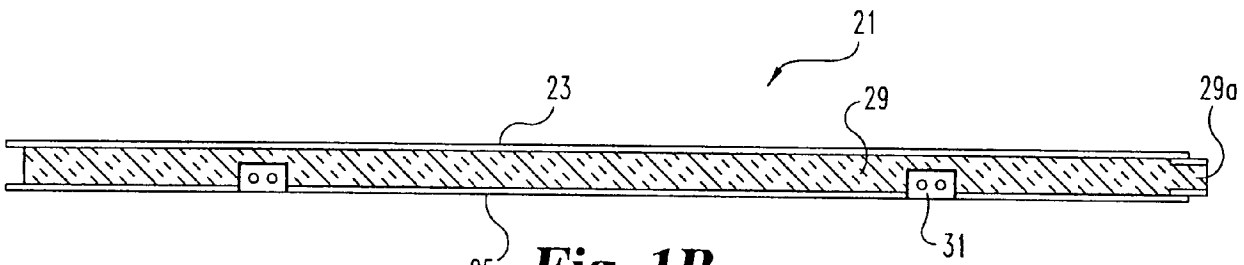
FIG. 1B is a sectional view taken along line 1B-1B of FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device and method, and further applications of the principles of the invention as illustrated therein are herein contemplated as would normally occur to one skilled in the art to which the invention relates.

Figure 1C:
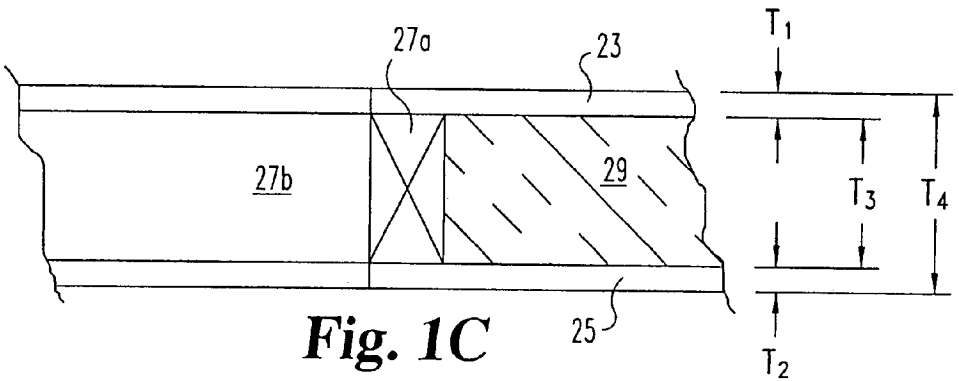
FIG. 1C is an enlarged view of portion of FIG. 1A.

Referring to the drawing figures, and in particular drawing FIGS. 1-5, panel 21 according the present invention is provided. The panel has a first, exterior-facing sheet 23 of a generally rigid material, and further has a second, interior-facing sheet 25 of a generally rigid material. Sheets 23 and 25 preferably are made from a wood-based material, for example plywood or OSB board, the later being generally preferable. Such sheets each have a thickness, most preferably 7/16 inches thick, but ordinarily in the range of about half an inch in thickness. Such thickness is illustrated as thicknesses $T_1$ and $T_2$ in FIG. 1C. The sheets 23 and 25 are generally parallel to each other, being spaced apart by framing struts located between the sheets. There are typically at least two, and usually more framing struts per panel, these framing struts are illustrated in the drawings as struts 27*a*, 27*b*, 27*c*, 27*d*, 27*e*, 27*f*, 27*g*, 27*h*, 27*i* and 27*j*. The struts may follow the entire perimeter of sheets 23 and 25. Such framing struts preferably have a strut thickness $T_3$ (see FIG. 1C) of 3 3/16 inches in actual dimension, although they may be within about ¼ inch, and preferably a ⅛ inch range, plus or minus, of that dimension (e.g., $T_3$=3 inches). Typically, the sheets 23 and 27 are secured to the framing struts by nails, screws or other fastener. The spaces formed in the panel volume line between sheets 23 and 24 and the framing struts. This volume, while initially air, is substantially filled with a polymeric in-situ foam core 29. Preferably, this foam cores is a rigid foam preferred in-situ, and preferably comprises polyurethane. It is understood that other foams having suitable insulation properties, and preferably rigid structural properties may be used, including other polymers as well as blends and/or copolymers with polyurethane. In practice, applicant has used BASF brand autofroth spray polyurethane including BASF 102B9453 resin and 9300A isocyannate blended together. This polyurethane foam expands in-situ in the panel volume, contacting the interior surfaces of sheets 23 and 25 as well as the framing struts, which are typically made of wood. When the foam cures, it adheres to such members, further integrating their strength and adding to the non-compressibility of the overall panel structure. Moreover, the foam servers to greatly enhance the thermal insulation characteristics. Applicant has found that with the inventive panel being 4 inches thick, the thermal insulation qualities are in excessive in an R value of 15, in excess of an R value of 20, and actually achieve an R value through the foamed panel of about 25.

Preferably the foam to make core 29 is injected into the panel volume after the first and second sheets are secured to the strut members. The strut members act as dams, either completely enclosing the panel volume, or alternatively partially enclose the panel volume. In the case of a partial enclosure, temporary dams are held in place to prevent the foam from oozing out until it cures. In either event, the foam is injected around the perimeter under pressure, typically in series, typically at injection openings in the struts approximately ever 4 feet around the entire perimeter. This is done while the panels are held in compression horizontally under a large press with medal beams so as to confine expansive deflection of the panel sheets.

The in-situ foaming is often done with electrical boxes, such as electrical box 31 and 35, and electrical conduit connecting such boxes, such as conduit 33 in place. Such electrical boxes and conduits are prefabricated into the panel mounted flush with interior sheet 25. Such mounting is done prior to injection of the in-situ foam. In this way, the in-situ foam surrounds such electrical boxes and conduits, further mechanically holding them in place and providing thorough insulation around such parts. Electrical boxes are typically placed, like the other features of the present invention, as a function of a floor plan design predetermining the location of such features. The electrical conduit extends to a perimeter access 37 (see FIG. 1) whereby on the job site electricians can access such conduit to wire electrical boxes appropriately to wall outlets, light switches and the like.

Figure 1:
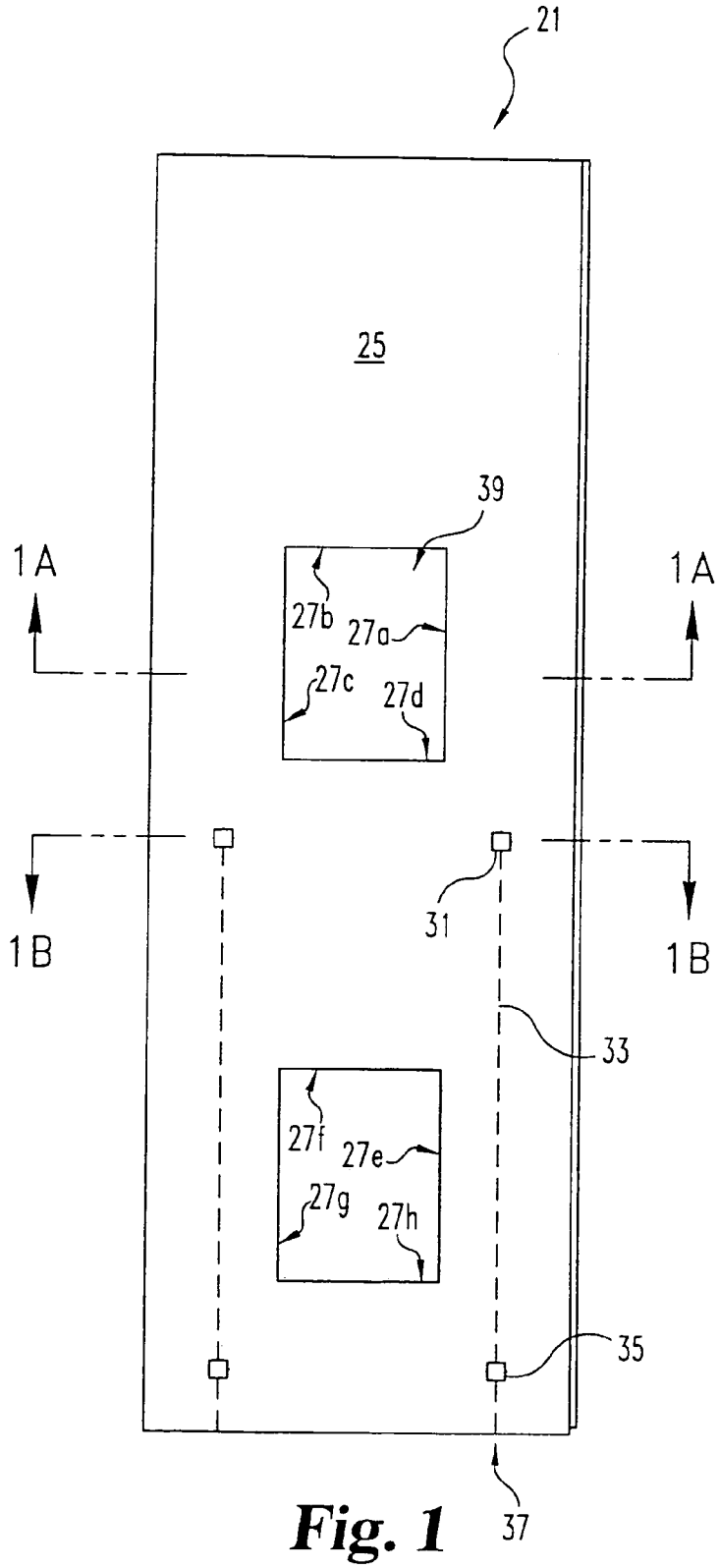
FIG. 1 is a front view of a representative sample of a panel made according to the present invention.
Figure 2:
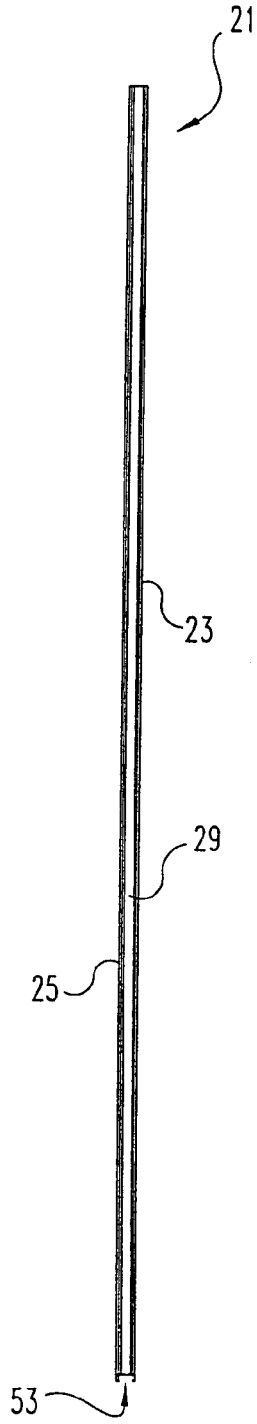
FIG. 2 is a side view of the device of FIG. 1.
Figure 7:
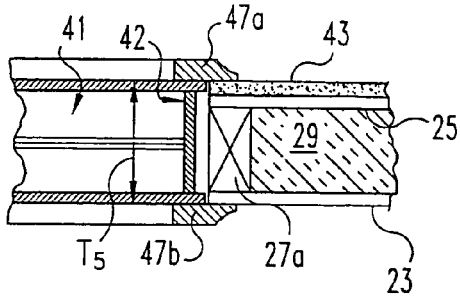
FIG. 7 is a top cross-sectional view of the present invention with a window, window jamb, drywall and trim; and, FIG. 8 is a top cross-sectional view of the present invention showing one version of a corner butt joint between two panels.

As seen in FIG. 1, one optional configuration of the present wall panel is to have a prefabricated window opening, such as window opening 39 in the panel. One or more such window openings can be made, and they may be made of any shape correspond to the window design for that part of the wall. As illustrated in FIG. 1, window opening 39 is partially defined by framing struts 27*a*, 27*b*, 27*c*, and 27*d*. This provides a structural member in which to mount the window jambs. They also act as dams that contain the in-situ foam from leaking out into the window opening 39. The window opening is filled with a window 31 (see FIG. 7), typically provided from a window vendor. The window has window jambs 42 having a thickness $T_5$. Many off the shelf window jambs have a thickness $T_5$ of 4 9/16 inches as a standard dimension. With the present invention having an overall panel thickness of approximately 4 inches (plus or minus a quarter inch), and more preferably 4 1/16 inches in the most preferred form, when the drywall sheet 43 is secured to the interior sheet 25, the overall thickness of the wall panel in combination with the ½ inch drywall is either exactly 4 9/16 inches thick, or closely approaches that dimension. In this way, with a finished assembly, the window jamb 42 is flush with the exterior of surface exterior sheet 23 and with the interior surface of the drywall 43. One advantage of this is that trim pieces 47*a* and 47*b* are conveniently and cost effectively mounted flush across the jamb 42 and the drywall as well as along the outside surface of the assembly as illustrated in FIG. 7. This is accomplished while providing thermal characteristics described above and a structural wall that is extremely strong. This is done with a thinner wall assembly, thereby facilitating a prefabricated wall panel that may be transported in less total volume on a truck than with a thicker prefabricated wall panel.

Figure 6:
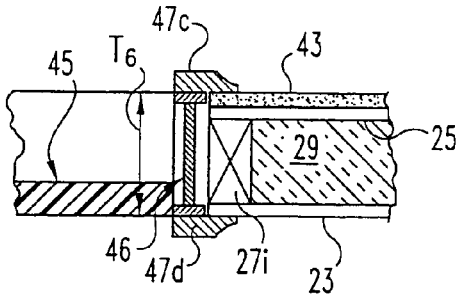
FIG. 6 is a top sectional view of the present invention with a door, door jamb, drywall and trim.

Similarly, FIG. 6 illustrates the present invention in connection with a door jamb 46 of a door 45 rather than a window assembly. This may be created by a cut opening in a wall panel, but more commonly curves at the butt end of 2 wall panels on either side of the door. As with window jamb thickness $T_5$, the door jamb 46 has a thickness $T_6$ which often is an industry standard 4 9/16 inches. As such, in combination with the half-inch thickness of the drywall sheet 43, wall panel thickness $T_4$ (see FIG. 1C) is most ideally 4 1/16 inches, or at least 1-quarter inch plus or minus 1-quarter inch. In this way, the advantages discussed above may likewise be utilized, including the cost effective flush mounting of trim pieces 47*c* and 47*d*.

It should be noted that the drawing illustrations set forth and described are mere examples of the present invention. Various types of other arrangements of the foam core, first and second sheets and strut members may be adapted to achieve advantages of the present invention.

Figure 3:
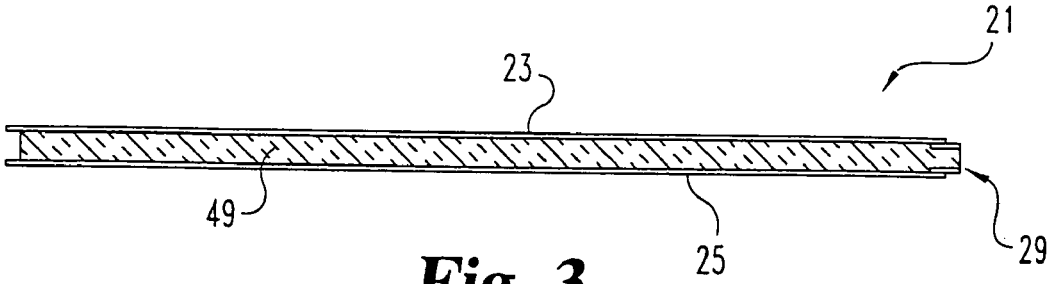
FIG. 3 is a top view of the device of FIG. 1.
Figure 4:
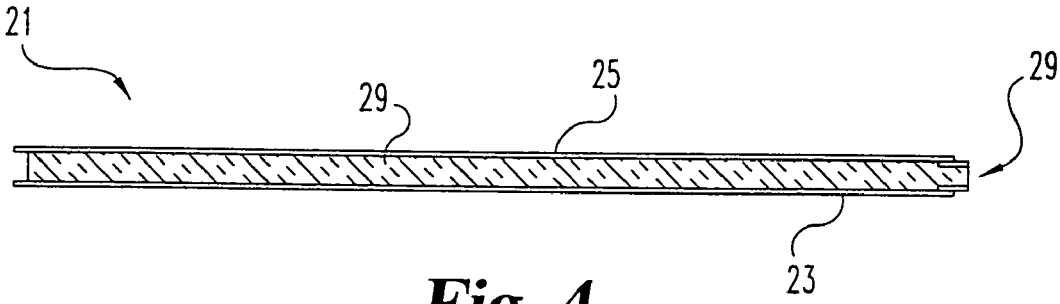
FIG. 4 is a bottom view of the device of FIG. 1.
Figure 5:
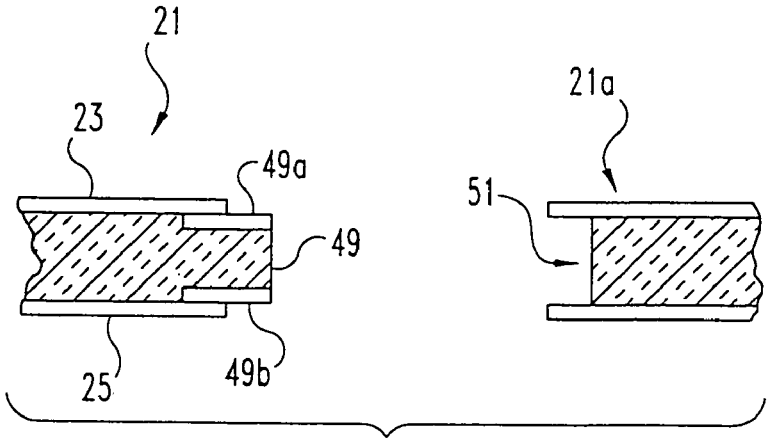
FIG. 5 is a partial top view of one optional type of joining section between wall panels according to the present invention.
Figure 8:
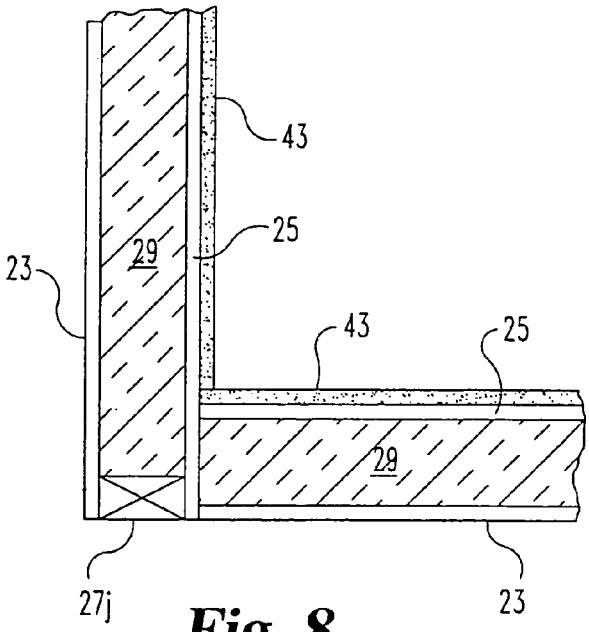

Merely by way of example, with reference to FIG. 5, an arrangement is illustrated two wall panels 21 and 21*a* may be joined together. In particular, panel 21 includes along a first vertical side edge a male projection 49. This male projection member is adapted to project into corresponding female reception recess 51 on adjacent panel 21*a*. As can be seen in FIGS. 3 and 3, a single panel may have a male member at one end and a female member at the opposite vertical side edge to facilitate interconnection of multiple panels along a wall. Note further that one optional, preferred mode of creating this connection, and in particular of creating projection member 49 is to have it formed by two projection flanges 49*a* and 49*b* (see FIG. 5). Preferably, these are cut from OSB or plywood and are lap jointed and secured along the inner edges sheets 23 and 25 secured thereto. Also, preferably these are left hollow so that in-situ foam may occupy the inner part of this male member as well. In this way, the finished assembly when the male projection 49 is inserted into the female portion 51, although the overall thickness is approximately 4 inches as described above, it occurs with insulating foam along all parts of the wall. In this way, there are no cold spots allowing thermal leakage. Alternatively, the end arrangements may be made including having the strut member flush with the perimeter edge of the paneling such as strut member 27*j* (see FIG. 8). Alternatively, as also seen in FIG. 8, selected wall panels may be formed with no internal strut member along a given edge of the wall panel, instead being formed with the foam in-situ as a temporary dam that is removed after the foam cures. Other approaches may be to modify preferred cross-sectional geometry of the framing struts. Although the preferred cross-sectional dimension of such struts is exactly 1½ inches by 3 3/16 inches, it may be modified within tolerance of this such as being 1½ inch by 3 inches. Moreover, it may be formed by a larger cross-sectional piece of wood cut, such as by rabbetting. In this way, a generally L-shaped piece of wood is formed with a rabbet having a cut thickness corresponding to either sheet 23 or 25 sitting within the rabbet, while nevertheless maintaining the interior spacing between such sheets (thickness $T_3$) at distances to achieve the dimensions preferred in the present invention with the overall wall thickness $T_4$. For example, a rabbet could be cut three quarter inch by 7/16 inch to accommodate a 7/16 inch OSB board.

Another optional feature is the formation of a bottom female recess 53 (see FIG. 2) formed between sheets 23 and 25 on either side of a recess on the bottom perimeter edge in the foam 29. This recess ordinarily has a vertical dimension of 1½ inches and a horizontal dimension identical to the spacing $T_3$ between the sheets. This recess is used in onsite assembly of the wall panels to be built into a building assembly. Typically, after the floor structure is build, footers, typically made of wood (dimension the same as the struts in the present invention) are fastened to the floor. Thereafter, wall panels are located on such footers with recess 53 sliding over such footers for securement thereto. This helps control the layout of wall panels and provide a secure basis for attachment together with the remainder of the structure.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A pre-fabricated wall panel usable with a door or window jamb with trim yet without jamb furring, comprising:

a first, exterior facing sheet of generally rigid material and having a first thickness and a first sheet perimeter;

a second, interior facing sheet of generally rigid material and having a second thickness and a second sheet perimeter, said second sheet being generally parallel to said first sheet and spaced therefrom a strut thickness;

at least two framing struts being located between said first sheet and said second sheet and having said strut thickness to define a panel volume between said first sheet, said second sheet, and said framing struts;

a polymeric in-situ foam core located in and substantially filling said panel volume;

said framing struts acting as at least part of a dam to help contain said in-situ foam within said panel volume;

an overall panel thickness including the sum of said first thickness, said second thickness and said strut thickness, said overall panel thickness being between approximately 3¾ inches and 4¼ inches;

a jamb member adjacent at least one of said struts, said jamb having a jamb thickness;

a sheet of drywall having a drywall thickness and adjacent said interior facing sheet, said drywall having an interior surface;

a trim piece; and, wherein said jamb thickness is substantially equal to the sum of said overall panel thickness and said drywall thickness, such that said jamb is substantially flush therewith for said trim piece to be mounted flush across the jamb and drywall without the use of furring.

2. The pre-fabricated wall panel of claim 1 and further comprising at least one electrical box located between said first sheet and said second sheet and at least one conduit for electrical wires running between said electrical box and said first sheet perimeter, and wherein said in-situ foam at least partially surrounds said electrical box and said conduit.

3. The pre-fabricated wall panel of claim 2 and further comprising a window opening correspondingly cut in said first sheet and said second sheet, and wherein said window opening is partially defined by strut members around a perimeter thereof.

4. The pre-fabricated wall panel of claim 3 and further comprising a window mounted in said window opening, said window having window jambs having a thickness of 4 9/16 inches and being mounted in substantially flush alignment with said overall panel thickness.

5. The pre-fabricated wall panel of claim 4 wherein said wall panel has a thermal insulation R-value through a foam containing portion of said thickness of at least 20.

6. The pre-fabricated wall panel of claim 5 wherein the panel has a first vertical side edge having a male projection member adapted to project into a corresponding female reception member on an adjacent panel.

7. The pre-fabricated wall panel of claim 6 wherein said first side panel and said second side panel are made from wood-based material.

8. The pre-fabricated wall panel of claim 7 wherein said in-situ foam is a rigid foam cured in-situ substantially comprising polyurethane.

9. The pre-fabricated wall panel of claim 8 wherein said struts comprise wooden struts having an actual cross-sectional dimensioning of about 1½ inches by 3 3/16 inches.

10. The pre-fabricated wall panel of claim 9 having a ½ inch thick sheet of drywall secured adjacent said second panel, said drywall having an interior surface that is flush with a jamb member interior edge.

11. The pre-fabricated wall panel of claim 1 and further comprising a window opening correspondingly cut in said first sheet and said second sheet, and wherein said window opening is partially defined by strut members around a perimeter thereof.

12. The pre-fabricated wall panel of claim 11 and further comprising a window mounted in said window opening, said window having window jambs having a thickness of 4 9/16 inches and being mounted in substantially flush alignment with said overall panel thickness.

13. The pre-fabricated wall panel of claim 1 wherein said wall panel has a thermal insulation R-value through a foam containing portion of said thickness of at least 20.

14. The pre-fabricated wall panel of claim 1 wherein the panel has a first vertical side edge having a male projection member adapted to project into a corresponding female reception member on an adjacent panel.

15. The pre-fabricated wall panel of claim 1 wherein said first side panel and said second side panel are made from wood-based material.

16. The pre-fabricated wall panel of claim 1 wherein said in-situ foam is a rigid foam cured in-situ substantially comprising polyurethane.

17. The pre-fabricated wall panel of claim 1 wherein said struts comprise wooden struts having an actual cross-sectional dimensioning of about 1½ inches by 3 3/16 inches.

18. The pre-fabricated wall panel of claim 1 having a ½ inch thick sheet of drywall secured adjacent said second panel, said drywall having an interior surface that is flush with a jamb member interior edge.

19. The pre-fabricated wall panel of claim 1 wherein said jamb has a thickness of 4 9/16 inches and said drywall has a thickness of ½ inch.

20. The pre-fabricated wall panel of claim 1 wherein said wall panels have a thermal insulation R-value through a foam containing portion of said thickness of at least 20; wherein said struts comprise wooden struts having an actual cross-sectional dimensioning of about 1½ inches by 3 3/16 inches; and, wherein said first sheet and said second sheet are each made from 7/16 inch thick OSB.

21. A pre-fabricated wall panel usable with a sheet of drywall, a door or window jamb adjacent the panel, and a trim piece, the jamb having a jamb thickness, the sheet of drywall having a drywall thickness, and the jamb member securable thereto with the trim piece to be mounted flush across the jamb and drywall without jamb furring, comprising:

a first, exterior facing sheet of generally rigid material and having a first thickness and a first sheet perimeter;

a second, interior facing sheet of generally rigid material and having a second thickness and a second sheet perimeter, said second sheet being generally parallel to said first sheet and spaced therefrom a strut thickness;

at least two framing struts being located between said first sheet and said second sheet and having said strut thickness to define a panel volume between said first sheet, said second sheet, and said framing struts;

a polymeric in-situ foam core located in and substantially filling said panel volume;

said framing struts acting as at least part of a dam to help contain said in-situ foam within said panel volume;

an overall panel thickness including the sum of said first thickness, said second thickness and said strut thickness, said overall panel thickness being between approximately 3¾ inches and 4¼ inches;

wherein the jamb thickness is adapted to be assembled substantially flush to the panel and drywall without the use of furring.

22. The pre-fabricated wall panel of claim 21 and further comprising at least one electrical box located between said first sheet and said second sheet and at least one conduit for electrical wires running between said electrical box and said first sheet perimeter, and wherein said in-situ foam at least partially surrounds said electrical box and said conduit.

23. The pre-fabricated wall panel of claim 22 wherein said wall panel has a thermal insulation R-value through a foam containing portion of said thickness of at least 20.

24. The pre-fabricated wall panel of claim 22 wherein the panel has a first vertical side edge having a male projection member adapted to project into a corresponding female reception member on an adjacent panel.

25. The pre-fabricated wall panel of claim 22 wherein said first side panel and said second side panel are made from wood-based material.

26. The pre-fabricated wall panel of claim 22 wherein said in-situ foam is a rigid foam cured in-situ substantially comprising polyurethane.

27. The pre-fabricated wall panel of claim 22 wherein said struts comprise wooden struts having an actual cross-sectional dimensioning of about 1½ inches by 3³⁄₁₆ inches.

28. The pre-fabricated wall panel of claim 22 having a ½ inch thick sheet of drywall secured adjacent said second panel, said drywall having an interior surface that is flush with a jamb member interior edge.

29. The pre-fabricated wall panel of claim 21 wherein said wall panels have a thermal insulation R-value through a foam containing portion of said thickness of at least 20; wherein said struts comprise wooden struts having an actual cross-sectional dimensioning of about 1½ inches by 3³⁄₁₆ inches; and, wherein said first sheet and said second sheet are each made from ⁷⁄₁₆ inch thick wood-based material.

30. A prefabricated building component, comprising:

a first sheet of generally rigid material having a first sheet perimeter;

a second sheet of generally rigid material having a second sheet perimeter, said second sheet is generally parallel to said first sheet;

a plurality of framing struts located between and spacing apart said first sheet and said second sheet to define a panel having an exterior thickness between approximately 3¾ inches and 4¼ inches, said panel having an interior volume;

a window receiving frame formed in said panel and adapted to receive a window therein, said window receiving frame includes a plurality of window struts adapted to receive fasteners to anchor the window; and a polymeric in-situ foam core substantially filling said interior volume.

31. The component of claim 30, which further comprises at least one electrical box located between said first sheet and said second sheet and at least one conduit for electrical wires running between said electrical box and said first sheet perimeter, and wherein said in-situ foam at least partially surrounds said electrical box and said conduit.

32. The component of claim 31, wherein the first sheet, the second sheet, the plurality of framing struts and the plurality of window struts are fixtured during the substantial filling of the interior volume with said foam core.

33. A prefabricated building component, comprising:

a first sheet of generally rigid material having a first sheet perimeter;

a second sheet of generally rigid material having a second sheet perimeter, said second sheet is generally parallel to said first sheet;

a plurality of framing struts located between and spacing apart said first sheet and said second sheet to define a panel having an exterior thickness between approximately 3¾ inches and 4¼ inches, said panel having an interior volume;

at least one electrical box located between said first sheet and said second sheet and at least one conduit for electrical wires running between said electrical box and said first sheet perimeter; and a polymeric in-situ foam core substantially filling said interior volume and wherein said in-situ foam at least partially surrounds said electrical box and said conduit.

* * * * *